US006031341A

United States Patent [19]

Yoshizawa et al.

[11] Patent Number: 6,031,341

[45] Date of Patent: Feb. 29, 2000

[54] MINIATURIZED TRANSFORMER AND INVERTER CIRCUIT AND DISCHARGE TUBE GLOW CIRCUIT INCLUDING SUCH MINIATURIZED TRANSFORMER

[75] Inventors: Yoshihito Yoshizawa, Fukaya; Tooru Abe; Shunsuke Arakawa, both of Kumagaya, all of Japan

[73] Assignee: Hitachi Metals, Ltd., Tokyo, Japan

[21] Appl. No.: 08/825,587

[22] Filed: Apr. 1, 1997

Related U.S. Application Data

[63] Continuation of application No. 08/486,585, Jun. 7, 1995, abandoned.

[30] Foreign Application Priority Data

Jun. 10, 1994 [JP] Japan ..... 6-129046

[51] Int. Cl.[7] ..... H05B 37/02

[52] U.S. Cl. ..... 315/276; 315/219

[58] Field of Search ..... 148/305, 302, 148/304; 420/89; 315/276, 219

[56] References Cited

U.S. PATENT DOCUMENTS

| | | | |
|---|---|---|---|
| 3,371,244 | 2/1968 | Boland | 315/276 |
| 4,608,297 | 8/1986 | Shimada et al. | 428/215 |
| 4,881,989 | 11/1989 | Yoshizawa et al. | 148/302 |
| 4,985,088 | 1/1991 | Okamura et al. | 148/305 |
| 5,252,144 | 10/1993 | Martis | 148/121 |
| 5,428,266 | 6/1995 | Nilssen | 315/276 |
| 5,486,404 | 1/1996 | Nakajima et al. | 428/172 |

FOREIGN PATENT DOCUMENTS

| | | |
|---|---|---|
| 0299498 | 1/1989 | European Pat. Off. . |
| 3909747 | 10/1989 | Germany . |
| WO9101563 | 2/1991 | WIPO . |

*Primary Examiner*—Michael B Shingleton

*Attorney, Agent, or Firm*—Sughrue, Mion, Zinn, Macpeak & Seas, PLLC

[57] ABSTRACT

A miniaturized transformer including (a) a planer or rod-shaped magnetic core having a height of 3 mm or less and constituted by a laminate of thin ribbons each having a thickness of 30 $\mu$m or less, each thin ribbon being made of a nanocrystalline soft magnetic alloy having a structure at least partly occupied by crystal grains having an average crystal grain size of 100 nm or less, or an amorphous soft magnetic alloy, (b) at least one primary winding provided around the magnetic core, and (c) at least one secondary winding provided around the magnetic core.

10 Claims, 4 Drawing Sheets

MINIATURIZED TRANSFORMER AND INVERTER CIRCUIT AND DISCHARGE TUBE GLOW CIRCUIT INCLUDING SUCH MINIATURIZED TRANSFORMER

This is a continuation of application Ser. No. 08/486,585 filed Jun. 7, 1995 now abandoned.

BACKGROUND OF THE INVENTION

The present invention relates to an inverter circuit for use in a miniaturized cold-cathode fluorescent lamp, etc., a miniaturized transformer suitable for such an inverter circuit and a discharge tube glow circuit including such an inverter circuit.

Liquid crystal displays used in notebook-type or laptop-type personal computers, electronic notebooks, portable telephone sets, etc. comprise cold-cathode fluorescent lamps (CCFL), light-conducting plates (edge light-type light source panels), etc. for backlight. To energize these light sources, an inverter circuit is necessary as a power supply.

The CCFL is suitable as a backlight for a liquid crystal display because it has a high efficiency and easily emits white light. However, since the CCFL needs an inverter circuit generating high voltage, it has not easily been assembled into a miniaturized portable electronic equipment because the miniaturization of the inverter circuit is limited. As a result, photodiodes were used in various kinds of miniaturized portable electronic equipment in many cases.

A conventional inverter circuit for the CCFL comprises a booster transformer including a ferrite core, and the booster transformer occupies a considerable space in the inverter circuit, preventing the inverter circuit from being miniaturized. Examples of such inverter circuits and transformers are shown in FIGS. 4(*a*) and 4(*b*). As shown in FIG. 4(*a*), the secondary winding side of the transformer 1 is connected to a discharge tube 3. The transformer 1 comprises a closed magnetic circuit-type ferrite core provided with a primary winding and a secondary winding. Accordingly, the miniaturization of the transformer 1 has been difficult, leaving the inverter circuit large in size. Also, since the discharge tube 3 has negative resistance characteristics opposite to those of general resistors in the relation of voltage and current, guide current is stabilized by a ballast capacitor 2 disposed between the discharge tube 3 and the transformer 1, and the ballast capacitor 2 serves to prevent the miniaturization of the inverter circuit.

With respect the above problems, it was reported that the inverter circuit can be miniaturized by using as a booster transformer a magnetic flux leak-type transformer having weakly coupled primary winding and secondary winding. Examples of such inverter circuits and magnetic flux leak-type transformers are shown in FIGS. 5(*a*) and 5(*b*). In a magnetic flux leak-type transformer 6 whose coupling coefficient drastically changes depending on a load, as the current increases after the start of discharge, voltage decreases and current increases to a stable stationary state at the secondary winding, thereby making the ballast capacitor 2 unnecessary. Since the ballast capacitor is the most likely cause to troubles, the omission of the ballast capacitor contributes to the improvement of reliability of the inverter circuit.

However, under circumstances that further miniaturization and reduction in thickness are desired in liquid crystal displays assembled in note-type or laptop-type personal computers, electronic notebooks, portable telephone sets, etc., the CCFL used for backlight appears to fail to provide enough miniaturization as long as a transformer of the CCFL is composed of ferrite.

Specifically, when magnetic cores of ferrite are made thin or small, they show deteriorated soft magnetic properties, failing to obtain the desired characteristics, and are likely to be broken. Also, since ferrite has a low saturation magnetic flux density and a relatively low effective permeability, magnetic cores made of ferrite cannot be made small drastically. Further, since the magnetic cores of ferrite have poor temperature characteristics, the performance of the transformer changes from an initial stage in which the temperature of the magnetic core is low to a stage after a certain period of time in which the temperature of the magnetic core is elevated.

OBJECTS AND SUMMARY OF THE INVENTION

Accordingly, an object of the present invention is to provide a miniaturized transformer suitable for an inverter circuit used in miniaturized cold-cathode fluorescent lamp, etc.

Another object of the present invention is to provide a miniaturized inverter circuit having higher reliability than the conventional ones.

A further object of the present invention is to provide a discharge tube glow circuit including such a miniaturized inverter circuit.

As a result of intense research in view of the above objects, the inventors have found that when a miniaturized transformer is constituted by (a) a planer or rod-shaped magnetic core having a height of 3 mm or less, the magnetic core being constituted by a laminate of thin ribbons each having a thickness of 30 $\mu$m or less and made of a nanocrystalline soft magnetic alloy having a structure at least part of which is occupied by crystal grains having an average crystal grain size of 100 nm or less or an amorphous soft magnetic alloy, (b) at least one primary winding provided around the magnetic core, and (c) at least one secondary winding provided around the magnetic core, the miniaturized transformer can show a high performance and is suitable for a miniaturized inverter circuit, particularly for a discharge tube glow circuit, and that the inverter circuit including such a miniaturized transformer is small and highly reliable. The present invention has been accomplished based on these findings.

In a first aspect of the present invention, there is provided a miniaturized transformer comprising (a) a planer or rod-shaped magnetic core having a height of 3 mm or less, the magnetic core being constituted by a laminate of thin ribbons each having a thickness of 30 $\mu$m or less and made of a nanocrystalline soft magnetic alloy having a structure, at least part of which is occupied by crystal grains having an average crystal grain size of 100 nm or less, (b) at least one primary winding provided around the magnetic core, and (c) at least one secondary winding provided around the magnetic core.

In a second aspect of the present invention, there is provided a miniaturized transformer comprising (a) a magnetic core having a height of 3 mm or less and composed of a laminate of thin ribbons of an amorphous soft magnetic alloy each having a thickness of 30 $\mu$m or less, (b) at least one primary winding provided around the magnetic core, and (c) at least one secondary winding provided around the magnetic core.

BRIEF DESCRIPTION OF THE DRAWINGS

FIG. 4 (*b*) is a schematic cross-sectional view showing an example of a conventional transformer for a discharge tube;

FIG. 5 (*b*) is a schematic cross-sectional view showing an example of a conventional magnetic flux leak-type transformer for use in the inverter circuit of FIG. 5 (*a*).

DETAILED DESCRIPTION OF THE PREFERRED EMBODIMENTS

[1] Soft magnetic alloy

Figure 1:
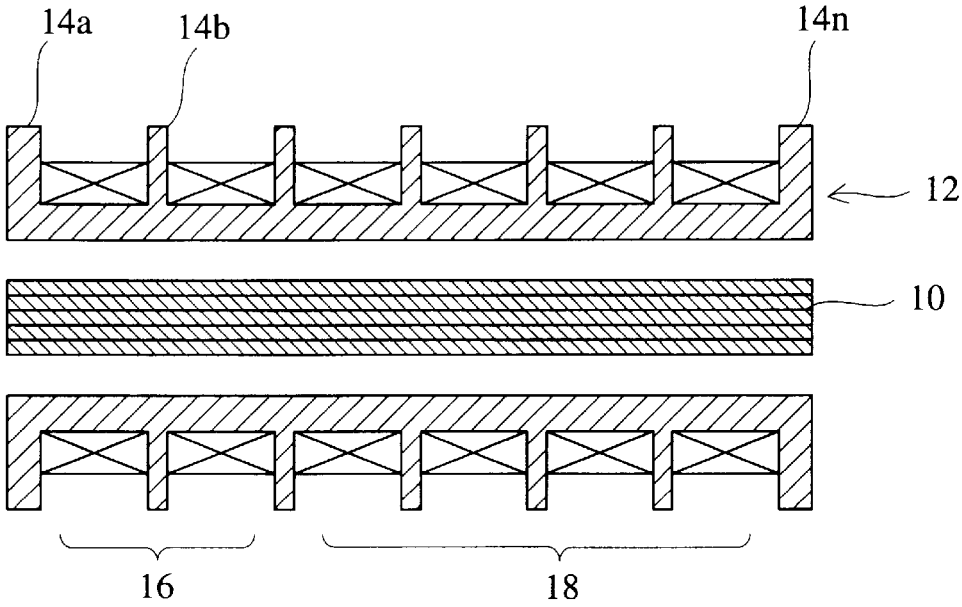
FIG. 1 is a schematic cross-sectional view showing an example of the miniaturized transformer according to the present invention.

The soft magnetic alloy for forming a magnetic core the miniaturized transformer of the present invention is a nanocrystalline soft magnetic alloy or an amorphous soft magnetic alloy.

(*a*) Nanocrystalline soft magnetic alloy

The nanocrystalline soft magnetic alloy used in the present invention is preferably represented by the general formula:

$$(Fe_{1-\alpha}M_{\alpha})_{100-x-y-z-\beta}A_xM'_yM''_zX_{\beta},$$

wherein M is at least one element selected from the group consisting of Co and Ni, A is at least one element selected from the group consisting of Cu and Au, M' is at least one element selected from the group consisting of Ti, V, Zr, Nb, Mo, Hf, Ta and W, M" is at least one element selected from the group consisting of Cr, Mn, Al, Sn, Zn, Ag, In, platinum group elements, Mg, Ca, Sr, Y, rare earth elements, N, O and S, X is at least one element selected from the group consisting of B, Si, C, Ge, Ga and P, and $\alpha$ (atomic ratio), and x, y, z and $\beta$ (atomic %) are numbers meeting the requirements of $0 \leqq \alpha \leqq 0.5$, $0 \leqq x \leqq 10$, $0.1 \leqq y \leqq 20$, $0 \leqq z \leqq 20$, and $2 \leqq \beta \leqq 30$.

The element M is effective to improve the corrosion resistance and magnetic properties of the alloy. Particularly Co serves to increase the temperature characteristics and corrosion resistance of the alloy, thereby improving the reliability of the miniaturized transformer. When the amount ($\alpha$) of the element M (atomic ratio relative to Fe+M) exceeds 0.5, the deterioration of soft magnetic properties takes place. The more preferred atomic ratio of M is 0–0.1.

The element A is effective to make crystal grains finer and suppress the formation of metallic compounds, thereby improving the soft magnetic properties of the alloy, reducing resonance current, and decreasing temperature elevation ($\Delta T$). The amount (x) of A is preferably 0–10 atomic %. When it exceeds 10 atomic %, the soft magnetic properties of the alloy are deteriorated, thereby increasing resonance current and temperature elevation ($\Delta T$). Also in the case of a thin ribbon, more than 10 atomic % of A would make the thin ribbon brittle. The more preferred amount of A is 0.1–3 atomic %.

The element M' is effective to make the crystal grains finer and improve the soft magnetic properties, thereby reducing resonance current and decreasing temperature elevation ($\Delta T$). The amount (y) of M' is preferably 0.1–20 atomic %. M' is preferably V, Zr, Nb, Mo, Hf, Ta and W, and more preferably Zr, Nb, Mo, Hf and Ta. When it exceeds 20 atomic %, the alloy has decreased saturation magnetic flux density and deteriorated soft magnetic properties, thereby making it difficult to miniaturize the transformer, increasing resonance current and temperature elevation ($\Delta T$). On the other hand, when it is lower than 0.1 atomic %, there is no effect of making the crystal grains finer, leaving the soft magnetic properties low and the temperature elevation ($\Delta T$) high. The more preferred amount of M' is 1–10 atomic %.

The element M" is effective to improve the corrosion resistance and magnetic properties of the alloy. M" is preferably Cr, Mn, Al and Sn, and more preferably Cr and Mn. The amount (z) of M" is preferably 0–20 atomic %. When it exceeds 20 atomic %, the saturation magnetic flux density of the alloy extremely decreases, thereby deteriorating the soft magnetic properties and making it difficult to miniaturize the transformer. The more preferred amount of M" is 0–10 atomic %.

The element X is effective to make the crystal grains finer and control the magnetostriction of the alloy, thereby improving the soft magnetic properties of the alloy, reducing resonance current, and decreasing temperature elevation ($\Delta T$). X is preferably B, Si and Ga, and more preferably B and Si. The amount ($\beta$) of X is preferably 2–30 atomic %. When it exceeds 30 atomic %, the alloy suffers from extremely decreased saturation magnetic flux density, lowered soft magnetic properties and deteriorated physical properties. On the other hand, when it is lower than 2 atomic %, the crystal grains are not made finer and the soft magnetic properties remain poor, increasing resonance current and temperature elevation ($\Delta T$). The more preferred amount of X is 2–26 atomic %.

The above-mentioned nanocrystalline soft magnetic alloy has a structure, at least part of which is occupied by crystal grains having an average crystal grain size of 100 nm or less. Particularly when the average grain size of the crystal grains is 50 nm or less, excellent soft magnetic properties can be obtained. More preferably, the average grain size of the crystal grains is 2–30 nm. The above fine crystal grains are preferably at least 50% of the alloy structure.

A thin ribbon of the nanocrystalline soft magnetic alloy can be produced by heat-treating a thin ribbon of an amorphous soft magnetic alloy formed by a rapid quenching method such as a single roll method. The heat treatment of the amorphous soft magnetic alloy is preferably conducted at 400° C.–700° C. When the heat treatment temperature is lower than 400° C., crystallization is difficult even though the heat treatment is conducted for a long period of time. On the other hand, when it exceeds 700° C., the crystal grains grow excessively, failing to obtain the desired average crystal grain size. The more preferred heat treatment temperature is 450–650° C. The heat treatment time is generally 1 minute to 48 hours, preferably 10 minutes to 24 hours. The heat treatment temperature and time may be determined within the above ranges depending upon the compositions of the alloys.

(b) Amorphous soft magnetic alloy

The amorphous soft magnetic alloy is preferably represented by the general formula:

$$(Co_{1-\delta}Fe_{\delta})_{100-p-q-r-\epsilon}M'''_pSi_qB_rX'_{\epsilon},$$

wherein M''' is at least one element selected from the group consisting of Mn, Ni, Ti, Zr, Hf, Cr, Mo, Nb, V, W, Ta, Cu, Ru, Rh, Pd, Os, Ir, Pt, Re and Sn, X' is at least one element selected from the group consisting of C, Ge, Ga, In, P and Al, and $\delta$ (atomic ratio), and p, q, r and $\epsilon$ (atomic %) are numbers meeting the requirements of $0 \leqq \delta \leqq 0.1$, $0 \leqq p \leqq 15$, $0 \leqq q \leqq 20$, $5 \leqq r \leqq 25$, $0 \leqq \epsilon \leqq 20$, and $15 \leqq q+r+\epsilon \leqq 30$.

The element Fe is effective to control the magnetostriction of the alloy and prevent the magnetic properties of the alloy from being deteriorated when laminated. When the amount ($\delta$) of the element Fe (atomic ratio relative to Co+Fe) exceeds 0.1, the alloy has too large magnetostriction and deteriorated soft magnetic properties, and increased resonance current and temperature elevation ($\Delta T$). The more preferred atomic ratio of Fe is 0.07 or less.

The element M''' is effective to improve the corrosion resistance and magnetic properties of the alloy. M''' is preferably Mn, Ni, Ti, Zr, Hf, Cr, Mo, Nb, V, W, Ta, Cu, Ru, Sn and Ru, and more preferably Mn, Ni, Cr, Mo, Nb and Ta. The amount (p) of M''' is preferably 0–15 atomic %. When it exceeds 15 atomic %, the saturation magnetic flux density of the alloy extremely decreases. The more preferred amount of M''' is 0–10 atomic %.

The element Si is effective to make it easy to form an amorphous alloy, and improve the high-frequency magnetic properties, reduce the resonance current, and decrease the temperature elevation ($\Delta T$). The amount (q) of Si is preferably 0–20 atomic %. When it exceeds 20 atomic %, the alloy becomes brittle, making it difficult to obtain a continuous ribbon, also extremely decreasing the saturation magnetic flux density and deteriorating the temperature characteristics. The more preferred amount of Si is 5–18 atomic %.

The element B is an amorphous-forming element effective to improve the soft magnetic properties of the alloy, reduce the resonance current, and decrease the temperature elevation ($\Delta T$). The amount (r) of B is preferably 5–25 atomic %. When it exceeds 25 atomic %, the alloy becomes brittle, making it difficult to obtain a continuous ribbon and extremely decreasing the saturation magnetic flux density. On the other hand, when it is lower than 5 atomic %, it is difficult to form an amorphous alloy. The more preferred amount of B is 7–18 atomic %.

The element X' is effective to make it easy to form an amorphous alloy and improve the magnetic properties. X' is preferably C, Ge, Ga, In and P, and more preferably C, Ge, Ga and P. The amount ($\epsilon$) of X' is preferably 0–20 atomic %. When it exceeds 20 atomic %, the saturation magnetic flux density of the alloy extremely decreases. The more preferred amount of X' is 0–10 atomic %.

The total amount ($q+r+\epsilon$) of Si, B and X' is preferably 15–30 atomic %. When $q+r+\epsilon$ exceeds 30 atomic %, the saturation magnetic flux density of the alloy extremely decreases, and extreme deterioration of physical properties ensues. On the other hand, when it is lower than 15 atomic %, it is difficult to form an amorphous alloy, and the core loss increases, resulting in an increase in the temperature elevation ($\Delta T$). The more preferred amount of $q+r+\epsilon$ is 20–28 atomic %.

A thin ribbon of the amorphous soft magnetic alloy can be produced by a rapid quenching method such as a single roll method. The amorphous soft magnetic alloy may be heat-treated at 550° C. or lower, as long as the heat treatment does not crystallize the alloy structure.

[2] Magnetic core (a) Thin ribbon

Each thin ribbon has a thickness of 30 $\mu$m or less, because a lower core loss can be achieved by thinner thin ribbons. The thickness of the thin ribbon is preferably 25 $\mu$m or less, more preferably 2–15 $\mu$m.

The laminate of thin ribbons can be formed by bonding the thin ribbons with a resin, by binding the thin ribbons with a band, or disposing the thin ribbons in a casing, etc. When each thin ribbon is coated with an insulating layer or film, better results can be obtained by suppressing eddy current loss. Preferred insulating materials are colloidal silica, lithium silicate, $Al_2O_3$, MgO, etc. The insulating layer may have a thickness of 0.01–4 $\mu$m, preferably 0.1–2 $\mu$m. If particularly high dimensional accuracy is needed, surfaces of the laminated thin ribbons are preferably ground or polished.

It should be note that the magnetic core may be formed by thin films of nanocrystalline soft magnetic alloys or amorphous soft magnetic alloys each formed by sputtering, etc.

(b) Configuration of magnetic core

The miniaturized transformer of the present invention comprises a planer or rod-shaped magnetic core having a height of 3 mm or less, the magnetic core being constituted by a laminate of thin ribbons each having a thickness of 30 $\mu$m or less. The height of the magnetic core is defined herein as a distance between two opposing surfaces of the laminate composed of a plurality of thin ribbons in a laminate direction. If the magnetic core has a height of more than 3 mm, sufficient miniaturization of the magnetic core cannot be achieved. The magnetic core preferably has a width of 3 mm or less. With a width of 3 mm or less, the magnetic core is in a rod shape having a square cross section, which can reduce the length of windings, leading to the miniaturization of a transformer while maintaining its performance. More preferably, the magnetic core has a height of 2 mm or less and a width of 2 mm or less.

Since the magnetic core of the present invention is composed of a laminate of thin ribbons made of soft magnetic material, nanocrystalline or amorphous, having a higher permeability than that of ferrite, it shows a smaller diamagnetic coefficient and a higher effective permeability than those of ferrite. Also, since the soft magnetic alloy used in the present invention has a large saturation magnetic flux density, a magnetic flux density with which the transformer is operated can be increased, leading to the miniaturization of the transformer. Further, since the soft magnetic alloy has a high Curie temperature, the properties of the soft magnetic alloy do not change as the ambient temperature is elevated, thereby keeping the operation of the miniaturized transformer stable.

Further, since the magnetic core has an increased inductance, the capacitance of a resonance capacitor can be reduced in a circuit design of the same resonance frequency. This results in a decrease in a resonance current, which in turn leads to the reduction of a loss in the resonance circuit. Also, since stress in other parts in the circuit is reduced, the other parts are less likely to be damaged, enhancing the reliability of the circuit.

Since the magnetic core of the present invention shows a smaller loss than that of ferrite cores in the case of a large operation magnetic flux density, the magnetic core of the present invention is subjected to smaller temperature elevation.

(c) Primary winding and secondary winding

The miniaturized transformer of the present invention comprises at least one primary winding and at least one secondary winding. When the primary winding and the secondary winding are independently disposed around the magnetic core with a certain space or gap in a longitudinal direction of the magnetic core, the primary winding and the secondary winding have increased breakdown voltage, making the miniaturized transformer suitable for high voltage applications. If at least one of the primary winding and the secondary winding is composed of separate windings, a parasitic capacity between the windings can be reduced, resulting in an increase in efficiency in the case of glowing the CCFL at a high frequency, thereby providing a higher-performance miniaturized transformer.

The miniaturized transformer of the present invention may have a structure in which the above-described magnetic core is disposed in a center of a bobbin made of an insulating material and provided with windings. In this case, winding can be conducted automatically, making it easy to form separate windings and also ensuring insulation between the primary winding and the secondary winding. Since separate windings reduce a parasitic capacity, the transformer can have a higher performance.

[3] Structure of miniaturized transformer

A typical example of the structure of the miniaturized transformer of the present invention is shown in FIG. 1. A magnetic core 10 constituted by laminated thin ribbons is disposed within a bobbin 12 having a plurality of flanges 14*a*, 14*b* . . . 14*n*, and each of the primary winding 16 and the secondary winding 18 is wound around the bobbin 12 between adjacent flanges.

[4] Discharge tube glow circuit including inverter circuit

Figure 2:
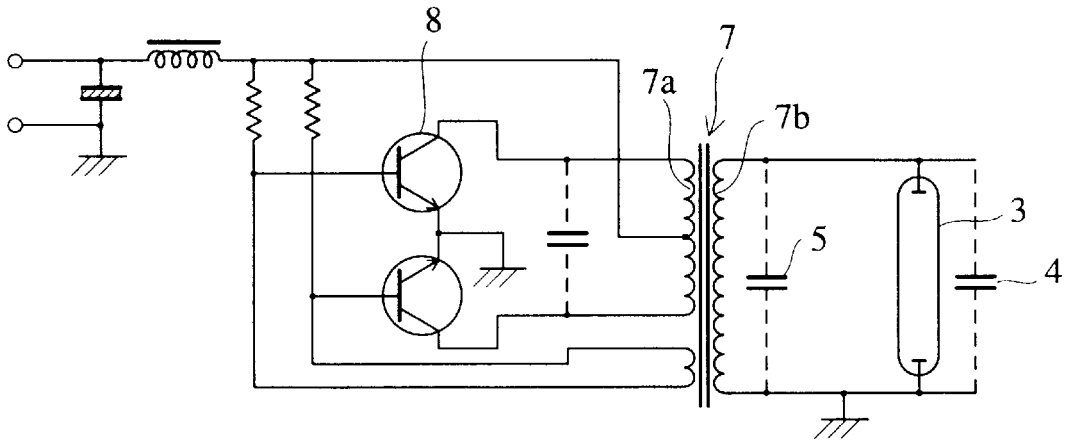
FIG. 2 is a schematic view showing an example of the discharge tube glow circuit according to the present invention.

As shown in FIG. 2, the discharge tube glow circuit comprises a transformer 7 whose secondary winding side is connected to a discharge tube 3. The transformer 7 is provided with a primary winding 7*a* and a secondary winding 7*b*. The primary winding side of the transformer 7 is connected to two transistors 8 for inverting the direct current to the alternating current. FIG. 2 also shows a parasitic capacity 4 of the discharge tube 3 and a parasitic capacity 5 of the secondary winding 7*b* of the transformer 7.

The inverter circuit including the miniaturized transformer can be made small and thin. Also, since the capacity of the resonance capacitor can be made small as compared with conventional circuits, resonance current can be reduced in the circuit. This leads to a decrease in a loss in the circuit, thereby reducing stress in other parts in the circuit. As a result, the other parts are less likely to be damaged, enhancing the reliability of the circuit. Also, the brightness of the discharge tube is increased.

Further, since the inverter circuit of the present invention is effective for the miniaturization and thinning of a discharge tube glow circuit in which a discharge tube is connected to the secondary side of the transformer, it is suitable for backlights of liquid crystal displays in note-type or laptop-type personal computers, electronic notebooks, portable telephone sets, computer game equipment, etc.

The present invention will be further described referring to the following Examples without intention of restricting the scope of the present invention.

EXAMPLE 1

A thin amorphous alloy ribbon having a width of 1.3 mm and a thickness of 18 μm was produced by quenching a molten alloy consisting essentially of 1.1 atomic % of Cu, 2.8 atomic % of Nb, 15.5 atomic % of Si, 6.5 atomic % of B, the balance being substantially Fe, by a single roll method. Each surface of the thin amorphous alloy ribbon was coated with colloidal silica to form a 0.3 μm-thick insulating layer. After cutting the ribbon to 20 mm, it was heat-treated in a furnace at 550° C. in an argon atmosphere for 30 minutes and then air-cooled. The heat-treated alloy ribbon had fine crystal grains having an average crystal grain size of about 10 nm. Next, the thin alloy ribbons were laminated to form a magnetic core of about 1.3 mm in height. The magnetic core was inserted into a bobbin provided with a primary winding and a secondary winding to produce the miniaturized transformer of the present invention shown in FIG. 1. The miniaturized transformer thus produced had a width of 4.3 mm, a height of 4.3 mm and a length of 20 mm, much smaller than conventional transformers comprising ferrite cores (typically diameter: 5 mm, length: 40 mm).

This miniaturized transformer was assembled into an inverter circuit operable at 120 kHz. A cold-cathode fluorescent lamp was connected to the secondary side of the miniaturized transformer to form a discharge tube glow circuit shown in FIG. 2. The measured inverter loss was 510 mW, drastically smaller than 670 mW of the conventional circuits.

EXAMPLE 2

A thin amorphous alloy ribbon having a width of 2 mm and a thickness of 15 μm was produced by quenching a molten alloy consisting essentially of 2.5 atomic % of Mo, 15 atomic % of Si, 9.5 atomic % of B, 4 atomic % of Mn, 2 atomic % of Fe, the balance being substantially Co, by a single roll method. Each surface of the thin amorphous alloy ribbon was coated with colloidal silica to form a 0.3 μm-thick insulating layer. After cutting the ribbon to 30 mm, it was heat-treated in a furnace at 420° C. in an argon atmosphere for 30 minutes and then air-cooled. It was confirmed by X-ray diffraction that the heat-treated alloy ribbon had an amorphous structure. Next, the thin alloy ribbons were laminated to form a magnetic core of about 2 mm in height. The magnetic core was inserted into a bobbin provided with a primary winding and a secondary winding to produce the miniaturized transformer of the present invention shown in FIG. 1. The miniaturized transformer thus produced had a width of 5 mm, a height of 5 mm and a length of 30 mm, much smaller than the conventional transformers comprising ferrite cores (typically diameter: 5 mm, length: 40 mm).

This miniaturized transformer was assembled into an inverter circuit, and a cold-cathode fluorescent lamp was connected to the secondary side of the miniaturized transformer to form a discharge tube glow circuit shown in FIG. 2. The measured inverter loss was 525 mW, drastically smaller than 670 mW of the conventional circuits.

EXAMPLE 3

A thin amorphous alloy ribbon having a width of 1.5 mm and a thickness of 15 μm was produced by quenching a molten alloy having a composition shown in Table 1 by a single roll method. Each surface of the thin amorphous alloy ribbon was coated with colloidal silica to form a 0.3 μm-thick insulating layer. After cutting the ribbon to 40 mm, it was heat-treated in a furnace at 550° C. in an argon atmosphere for 30 minutes and then air-cooled. The heat-treated alloy ribbon had fine crystal grains having an average crystal grain size of about 10–20 nm. Next, the thin alloy ribbons were laminated to form a magnetic core of about 1.5 mm in height. The magnetic core was inserted into a bobbin provided with a primary winding and a secondary winding to produce the miniaturized transformer of the present invention shown in FIG. 1.

This miniaturized transformer was assembled into an inverter circuit, and a cold-cathode fluorescent lamp was connected to the secondary side of the miniaturized transformer to form a discharge tube glow circuit shown in FIG. 2. The temperature elevation and resonance current of the transformer were measured. For comparison, a conventional transformer comprising a Mn—Zn ferrite core was also measured. The results are shown in Table 1.

TABLE 1

| No.* | Composition (atomic %) | Resonance Current (A) | ΔT (° C.) |
|---|---|---|---|
| 1 | $Fe_{bal.}Cu_1Nb_3Si_{14.5}B_8$ | 0.38 | 15 |
| 2 | $Fe_{bal.}Cu_1Nb_3Si_{15.5}B_{6.5}$ | 0.39 | 16 |
| 3 | $Fe_{bal.}Cu_1Nb_3Ta_{0.5}Si_{15.5}B_6$ | 0.40 | 17 |
| 4 | $Fe_{bal.}Cu_1Mo_3Cr_{0.5}Si_{15.5}B_6$ | 0.38 | 15 |
| 5 | $Fe_{bal.}Cu_1Nb_3V_{0.5}Si_{15.5}B_6$ | 0.37 | 15 |
| 6 | $Fe_{bal.}Cu_1Nb_3W_{0.5}Si_{15.5}B_6$ | 0.39 | 16 |
| 7 | $Fe_{bal.}Cu_1Nb_3Mn_{0.5}Si_{15.5}B_6$ | 0.38 | 15 |
| 8 | $Fe_{bal.}Cu_1Nb_3Hf_{0.5}Si_{15.5}B_6Al_1$ | 0.40 | 17 |
| 9 | $Fe_{bal.}Cu_1Nb_3Zr_{0.5}Si_{15.5}B_6$ | 0.38 | 15 |
| 10 | $Fe_{bal.}Cu_1Ta_{2.5}Si_{15.5}B_6$ | 0.39 | 16 |
| 11 | $Fe_{bal.}Cu_1Zr_6Si_2B_6$ | 0.40 | 17 |
| 12 | $Fe_{bal.}Cu_1Nb_2Si_{12.5}B_9$ | 0.39 | 16 |
| 13 | Mn—Zn Ferrite | 0.69 | 25 |

Note: *Nos. 1–12: within the scope of the present invention, and No. 13: outside the scope of the present invention.

As is clear from Table 1, the miniaturized transformer of the present invention is operated with a small resonance current, thereby reducing the chances of breakdown of other parts. Also, the miniaturized transformer of the present invention suffers from a smaller temperature elevation than the conventional transformer comprising an Mn—Zn ferrite core.

EXAMPLE 4

A thin amorphous alloy ribbon having a width of 1.5 mm and a thickness of 15 μm was produced by quenching a molten alloy having a composition shown in Table 2 by a single roll method. Each surface of the thin amorphous alloy ribbon was coated with lithium silicate to form a 0.3 μm-thick insulating layer. After cutting the ribbon to 50 mm, it was heat-treated in a furnace at 400° C. in an argon atmosphere for 60 minutes and then air-cooled. It was confirmed by X-ray diffraction that the heat-treated alloy ribbon had an amorphous structure. Next, the thin alloy ribbons were laminated to form a magnetic core of about 1.5 mm in height, and the magnetic core was inserted into a bobbin provided with a primary winding and a secondary winding to produce the miniaturized transformer of the present invention shown in FIG. 1.

This miniaturized transformer was assembled into an inverter circuit, and a cold-cathode fluorescent lamp was connected to the secondary side of the miniaturized transformer to form a discharge tube glow circuit shown in FIG. 2. The temperature elevation and resonance current of the transformer were measured. The results are shown in Table 2.

TABLE 2

| No.* | Composition (atomic %) | Resonance Current (A) | ΔT (° C.) |
|---|---|---|---|
| 1 | $Co_{bal.}Fe_4Nb_1Si_{15}B_{9.5}$ | 0.43 | 19 |
| 2 | $Co_{bal.}Fe_1Mn_3Mo_2Si_{15.5}B_{10}$ | 0.44 | 19 |
| 3 | $Co_{bal.}Fe_4Ni_5Ta_2Si_{15}B_{8.5}$ | 0.45 | 20 |
| 4 | $Co_{bal.}Fe_4Ni_5W_2Si_{15}B_{9.5}$ | 0.43 | 19 |
| 5 | $Co_{bal.}Fe_4Mn_5V_2Si_{15}B_{9.5}$ | 0.41 | 18 |
| 6 | $Co_{bal.}Fe_4Mn_1Cr_4Si_{11}B_{12}$ | 0.42 | 19 |
| 7 | $Co_{bal.}Fe_4Ni_5V_2Si_{15}B_9C_1$ | 0.43 | 19 |
| 8 | $Co_{bal.}Fe_4Ni_5Sn_{0.5}Si_{15}B_9$ | 0.45 | 20 |
| 9 | $Co_{bal.}Fe_4In_{0.5}Si_{14}B_{9.5}$ | 0.44 | 19 |
| 10 | $Co_{bal.}Fe_4Ru_2Cu_1Si_{14}B_9Ga_1$ | 0.43 | 19 |
| 11 | $Co_{bal.}Fe_4Ti_2Si_{12}B_{10}Ge_1$ | 0.46 | 20 |
| 12 | $Co_{bal.}Fe_4Zr_2Hf_{0.5}Si_{15}B_9P_{0.5}$ | 0.43 | 19 |
| 13 | Mn—Zn Ferrite | 0.69 | 25 |

Note: *Nos. 1–12: within the scope of the present invention, and No. 13: outside the scope of the present invention.

As is clear from Table 2, the miniaturized transformer of the present invention is operated with a small resonance current, thereby reducing the chances of breakdown of other parts. Also, the miniaturized transformer of the present invention suffers from a smaller temperature elevation than the conventional transformer comprising a Mn—Zn ferrite core.

EXAMPLE 5

Figure 3:
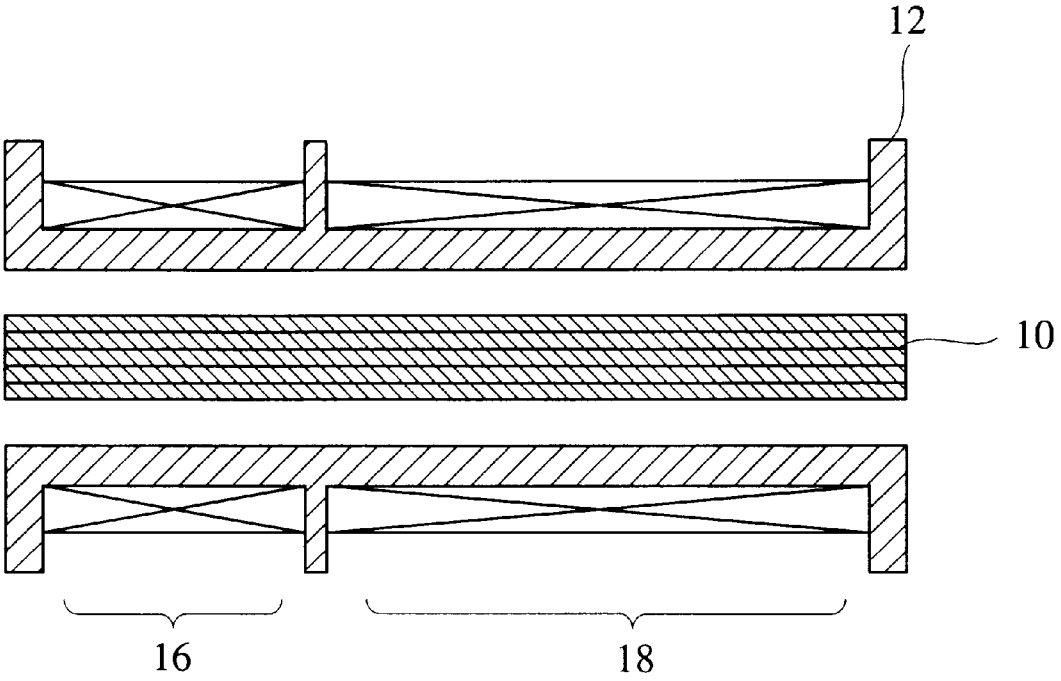
FIG. 3 is a schematic cross-sectional view showing an example of the transformer according to the present invention.
Figure 4:
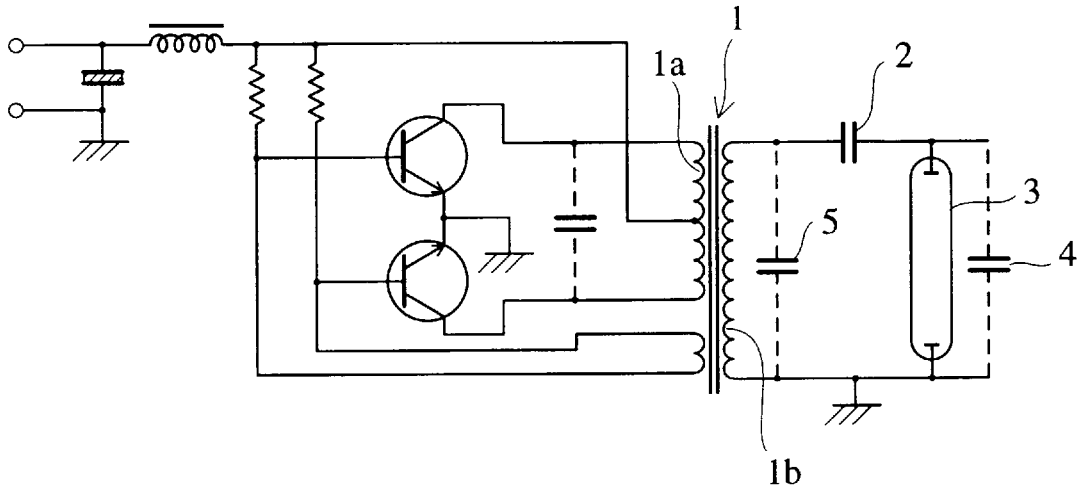
FIG. 4 (*a*) is a schematic view showing an example of a conventional inverter circuit for a discharge tube.
Figure 4:
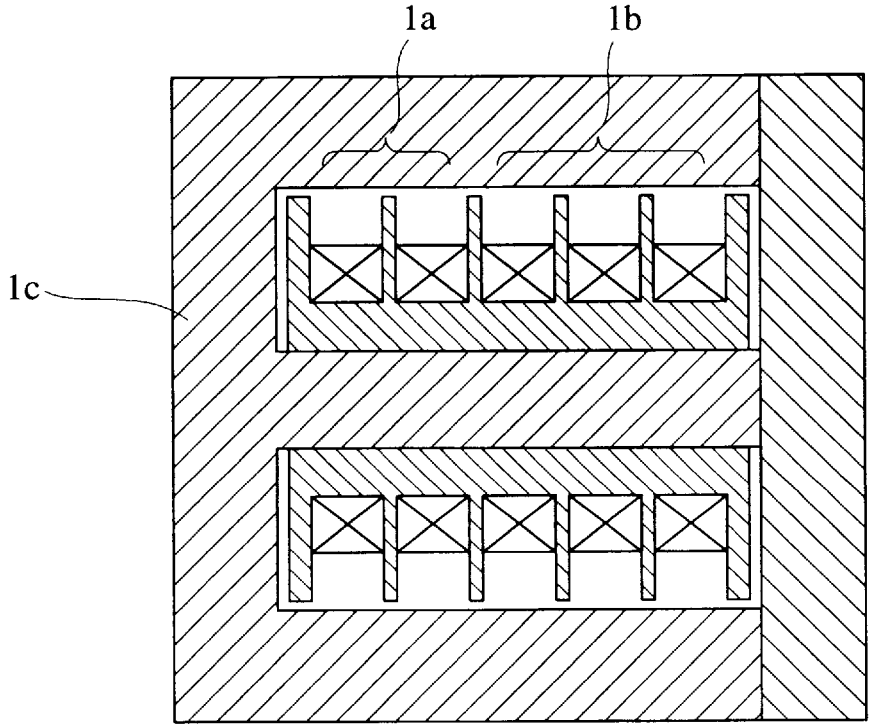
Figure 5:
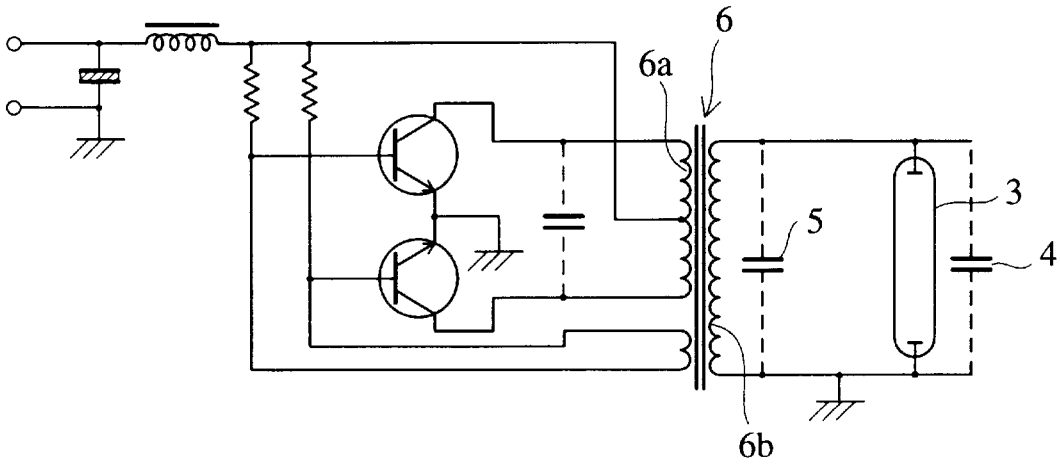
FIG. 5 (*a*) is a schematic view showing an example of a conventional inverter circuit for a discharge tube comprising a magnetic flux leak-type transformer.
Figure 5:
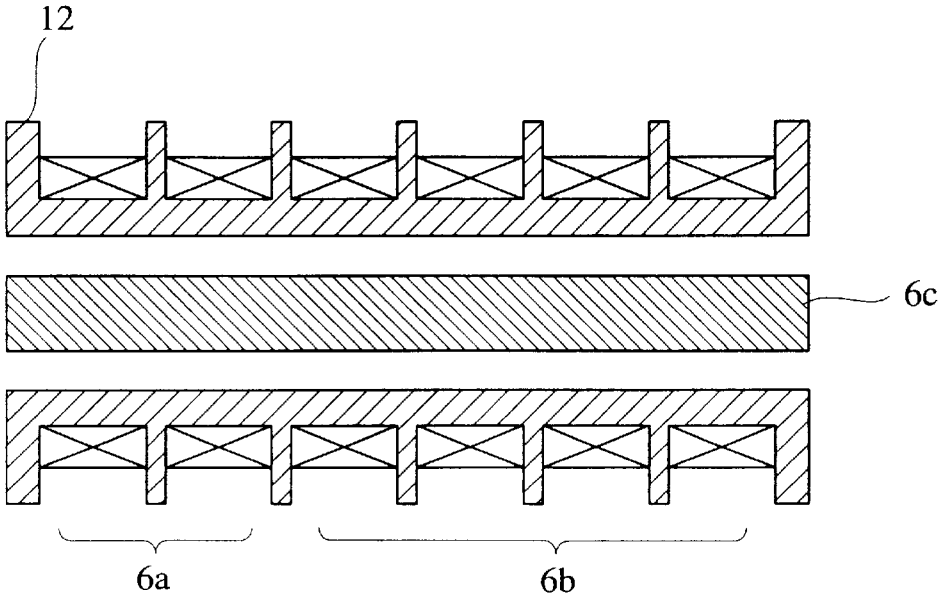

A thin amorphous alloy ribbon having a width of 1.5 mm and a thickness of 15 μm was produced by quenching a molten alloy consisting essentially of 1.1 atomic % of Cu, 2.8 atomic % of Nb, 15.5 atomic % of Si, 6.5 atomic % of B, the balance being substantially Fe, by a single roll method. Each surface of the thin amorphous alloy ribbon was coated with a 0.2 μm-thick insulating layer of $Al_2O_3$. After cutting the ribbon to 50 mm, it was heat-treated in a furnace at 550° C. in an argon atmosphere for 30 minutes while applying a magnetic field of 280 $kA \cdot m^{-1}$, cooled to 200° C. at a speed of 3° C./min and then air-cooled. It was confirmed that the structure of the heat-treated alloy was mostly occupied by fine crystal grains having an average crystal grain size of about 12 nm. Next, the thin alloy ribbons were laminated to form a magnetic core of about 1.5 mm in height. The magnetic core was inserted into a bobbin provided with a primary winding and a secondary winding to produce the miniaturized transformers of the present invention shown in FIGS. 1 and 3.

Each miniaturized transformer was assembled into an inverter circuit, and a cold-cathode fluorescent lamp was connected to the secondary side of the miniaturized transformer to form a discharge tube glow circuit shown in FIG. 2. The measured inverter loss was 525 mW when the secondary winding consisted of separate windings, smaller than 540 mW when the secondary winding consisted of a single winding.

EXAMPLE 6

A thin amorphous alloy ribbon having a thickness of 12 μm was produced by quenching a molten alloy consisting essentially of 1.1 atomic % of Cu, 3.1 atomic % of Nb, 14 atomic % of Si, 8.2 atomic % of B, the balance being substantially Fe, by a single roll method. The thin amorphous alloy ribbon was heat-treated in a furnace at 560° C. in an argon atmosphere for 60 minutes while applying a magnetic field of 280 $kA \cdot m^{-1}$, cooled to 200° C. at a speed of 3° C./min and then air-cooled. It was confirmed that the structure of the heat-treated alloy was mostly occupied by fine crystal grains having an average crystal grain size of about 12 nm. Next, the thin alloy ribbons were laminated and bonded with an epoxy resin to form a laminate of about 1.3 mm in thickness. This laminate was cut to a width of 1.3 mm and a length of 25 mm. Next, the cut laminate as a magnetic core was inserted into a bobbin provided with a primary winding and a secondary winding to produce the miniaturized transformer of the present invention shown in FIG. 1.

This miniaturized transformer was assembled into an inverter circuit, and a cold-cathode fluorescent lamp was connected to the secondary side of the miniaturized transformer to form a discharge tube glow circuit shown in FIG. 2. The measured temperature elevation was shown in Table 3. It was found that a smaller temperature elevation was obtained in the case of using thinner alloy ribbons.

TABLE 3

| Thickness of Alloy Ribbon ($\mu$m) | ΔT (° C.) |
|---|---|
| 3 | 11 |
| 5 | 12 |
| 7 | 13 |
| 10 | 14 |
| 15 | 15 |
| 20 | 18 |
| 25 | 23 |
| 30 | 25 |

As described in detail above, the miniaturized transformer of the present invention is highly reliable and suitable for an inverter circuit in a miniaturized cold-cathode fluorescent lamp, etc. and for discharge tube glow circuit including such an inverter circuit.

What is claimed is:

1. A discharge tube glow circuit comprising a cold-cathode fluorescent lamp, a magnetic flux leak-type transformer and an inverter for inverting direct current to alternating current, said magnetic flux leak-type transformer comprising: (a) a planar or rod-shaped magnetic core having a height of 3 mm or less, said magnetic core being constituted by a laminate of thin ribbons each having a thickness of 30 $\mu$m or less and made of a nanocrystalline soft magnetic alloy having a structure, at least part of which is occupied by crystal grains having an average crystal grain size of 100 nm or less, (b) at least one primary winding provided around said magnetic core and connected to said inverter, and (c) at least one secondary winding provided around said magnetic core and connected to said cold-cathode fluorescent lame, said nanocrystalline soft magnetic alloy being represented by the general formula:

$$(Fe_{1-\alpha}M_{\alpha})_{100-x-y-z-\beta}A_xM'_yM''_zX_{\beta},$$

wherein M is at least one element selected from the group consisting of Co and Ni, A is at least one element selected from the group consisting of Cu and Au, M' is at least one element selected from the group consisting of Ti, V, Zr, Nb, Mo, Hf, Ta and W, M" is at least one element selected from the group consisting of Cr, Mn, Al, Sn, Zn, Ag, In, platinum group elements, Mg, Ca, Sr, Y, rare earth elements, N, O and S, X is at least one element selected from the group consisting of B, Si, C, Ge, Ga and P, and a (atomic ratio), and x, y, z and β (atomic %) are numbers meeting the requirements of $0 \leqq \alpha \leqq 0.5$, $0 \leqq x \leqq 10$, $0.1 \leqq y \leqq 20$, $0 \leqq z \leqq 20$, and $2 \leqq \beta \leqq 30$.

2. A discharge tube glow circuit comprising a cold-cathode fluorescent lamp, a magnetic flux leak-type transformer and an inverter for inverting direct current to alternating current, said magnetic flux leak-type transformer, comprising (a) a magnetic core having a height of 3 mm or less and composed of a laminate of thin ribbons of an amorphous soft magnetic alloy having a thickness of 30 $\mu$m or less, (b) at least one primary winding provided around said magnetic core and connected to said inverter, and (c) at least one secondary winding provided around said magnetic core and connected to said cold-cathode fluorescent lamp, said amorphous soft magnetic alloy being represented by the general formula:

$$(Co_{1-\delta}Fe_{\delta})_{100-p-q-r-\epsilon}M'''_pSi_qB_rX'_{\epsilon},$$

wherein M"' is at least one element selected from the group consisting of Mn, Ni, Ti, Zr, Hf, Cr, Mo, Nb, V, W, Ta, Cu, Ru, Rh, Pd, Os, Ir, Pt, Re and Sn, X' is at least one element selected from the group consisting of C, Ge, Ga, In, P and Al, and δ (atomic ratio), and p, q, r and ϵ (atomic %) are numbers meeting the requirements of $0 \leqq \delta \leqq 0.1$, $0 \leqq p \leqq 15$, $5 \leqq q \leqq 18$, $5 \leqq r \leqq 25$, $0 \leqq \epsilon \leqq 20$, and $15 \leqq q+r+\epsilon \leqq 30$.

3. The discharge tube glow circuit according to claim 1, wherein said magnetic core has a width of 3 mm or less.

4. The discharge tube glow circuit according to claim 2, wherein said magnetic core has a width of 3 mm or less.

5. The discharge tube glow circuit according to claim 1, wherein said magnetic core has a height of 2 mm or less and a width of 2 mm or less.

6. The discharge tube glow circuit according to claim 2, wherein said magnetic core has a height of 2 mm or less and a width of 2 mm or less.

7. The discharge tube glow circuit according to claim 1, wherein said primary winding and said secondary winding are separate from each other in a longitudinal direction of said magnetic core.

8. The discharge tube glow circuit according to claim 2, wherein said primary winding and said secondary winding are separate from each other in a longitudinal direction of said magnetic core.

9. The discharge tube glow circuit according to claim 7, wherein at least one of said primary winding and said secondary winding consists of two or more separate windings.

10. The discharge tube glow circuit according to claim 8, wherein at least one of said primary winding and said secondary winding consists of two or more separate windings.

* * * * *